US011322273B2

(12) United States Patent
Lee et al.

(10) Patent No.: US 11,322,273 B2
(45) Date of Patent: May 3, 2022

(54) FLEXIBLE FLAT CABLE

(71) Applicant: SAMSUNG ELECTRONICS CO., LTD., Suwon-si (KR)

(72) Inventors: Jumyeong Lee, Suwon-si (KR); Joonmok Han, Suwon-si (KR); Donghyun Seo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/026,700

(22) Filed: Sep. 21, 2020

(65) Prior Publication Data

US 2021/0090760 A1 Mar. 25, 2021

(30) Foreign Application Priority Data

Sep. 20, 2019 (KR) ..... 10-2019-0116288

(51) Int. Cl.

| | |
|---|---|
| ***H01B 7/00*** | (2006.01) |
| ***H01B 7/08*** | (2006.01) |
| ***H01B 7/04*** | (2006.01) |
| ***H01R 12/78*** | (2011.01) |

(52) U.S. Cl.

CPC ..... *H01B 7/0846* (2013.01); *H01B 7/04* (2013.01); *H01R 12/78* (2013.01)

(58) Field of Classification Search

CPC ..... H01B 7/0846; H01B 7/04; H01R 12/78

See application file for complete search history.

(56) References Cited

U.S. PATENT DOCUMENTS 3,391,246 A * 7/1968 Freeman ..... H01B 7/0838 174/117 FF
3,820,053 A 6/1974 Champion et al.
4,066,840 A 1/1978 Allgaier
(Continued)

FOREIGN PATENT DOCUMENTS

CN 203434317 U 2/2014
JP 2002-319444 A 10/2002
(Continued)

OTHER PUBLICATIONS

Extended European Search Report dated Jan. 29, 2021, in corresponding European Patent Application No. 20194652.2.
(Continued)

*Primary Examiner* — Pete T Lee
(74) *Attorney, Agent, or Firm* — Staas & Halsey LLP

(57) ABSTRACT

A flexible flat cable capable of increasing space utilization in electronic devices by including a folding portion and by forming an independent conducting wire portion. The flexible flat cable includes a base film provided to extend in a first direction and configured to be foldable, a first conducting wire provided to extend in the first direction on the base film and including a first terminal provided at one end thereof and a first folding area terminal provided at the other end thereof, and a second conducting wire disposed next to the first conducting wire in the first direction, and including a second terminal provided at one end thereof and a second folding area terminal provided at the other end thereof, the second folding area terminal arranged spaced apart from the first folding area terminal of the first conducting wire in the first direction.

18 Claims, 12 Drawing Sheets

(56) References Cited

U.S. PATENT DOCUMENTS

| | | | | |
|---|---|---|---|---|
| 4,635,359 | A | 1/1987 | Nozick | |
| 2009/0126972 | A1* | 5/2009 | Matsushita | H01B 7/0861 174/113 R |
| 2009/0133898 | A1 | 5/2009 | Kojima et al. | |
| 2013/0037303 | A1* | 2/2013 | Wang | H01R 13/025 174/117 FF |
| 2015/0162700 | A1* | 6/2015 | Cho | H01R 13/5812 439/492 |
| 2016/0134039 | A1* | 5/2016 | Tomikawa | H05K 1/0216 439/65 |
| 2016/0329647 | A1 | 11/2016 | Okura et al. | |
| 2019/0045633 | A1* | 2/2019 | Chuo | H05K 1/0393 |

FOREIGN PATENT DOCUMENTS

| | | | |
|---|---|---|---|
| JP | 2010-272345 | A | 12/2010 |
| KR | 10-2014-0028753 | A | 3/2014 |
| KR | 10-2018-0010525 | A | 1/2018 |

OTHER PUBLICATIONS

International Search Report dated Jan. 14, 2021, in corresponding International Patent Application No. PCT/KR2020/012572.
Extended European Search Report dated Aug. 6, 2021, in corresponding European Patent Application 20194652.2.

* cited by examiner

FLEXIBLE FLAT CABLE

CROSS-REFERENCE TO RELATED APPLICATION(S)

This application is based on and claims priority under 35 U.S.C. § 119 to Korean Patent Application No. 10-2019-0116288, filed on Sep. 20, 2019, in the Korean Intellectual Property Office, the disclosure of which is incorporated by reference herein in its entirety.

BACKGROUND

1. Field

The disclosure relates to a flexible flat cable, and more particularly, to a flexible flat cable with improved space utilization and productivity.

2. Description of Related Art

In recent years, in the electronic technology, it has been important to improve degree of integration in semiconductor related devices, and produce smaller electronic devices and components related thereto. In particular, flexible flat cables used for signal transmission between various electronic components are increasingly in use due to their flexible characteristics, and the need for flexible flat cables applicable to complex and narrow spaces is also increasing.

In the conventional manner, a flexible flat cable is typically designed to have a conducting wire on a single surface. Therefore, when a connection through two flexible flat cables is needed, it may require a connector installed on opposite ends of the flexible flat cable, respectively, and thus total four connectors and two flexible flat cables may be required. Accordingly, it may lead to a decrease in space utilization and productivity.

SUMMARY

Therefore, it is an aspect of the disclosure to provide a flexible flat cable having improved space utilization.

It is another aspect of the disclosure to provide a flexible flat cable having processing efficiency, which is to obtain an effect of manufacturing two cables by manufacturing a single cable, while maintaining an existing manufacturing process.

It is another aspect of the disclosure to provide a flexible flat cable having material cost reduction effect in a manufacturing process.

Additional aspects of the disclosure will be set forth in part in the description which follows and, in part, will be obvious from the description, or may be learned by practice of the disclosure.

In accordance with an aspect of the disclosure, a flexible flat cable includes a base film provided to extend in a first direction and configured to be foldable, a first conducting wire provided to extend in the first direction on the base film and including a first terminal provided at one end thereof and a first folding area terminal provided at the other end thereof, and a second conducting wire disposed next to the first conducting wire in the first direction, and including a second terminal provided at one end thereof and a second folding area terminal provided at the other end thereof, the second folding area terminal arranged spaced apart from the first folding area terminal of the first conducting wire in the first direction.

The flexible flat cable may further include a cover film arranged on the base film to cover the first conducting wire and the second conducting wire, the cover film configured to expose the first terminal and the first folding area terminal of the first conducting wire and the second terminal and the second folding area terminal of the second conducting wire to the outside.

A direction in which the first terminal is exposed on the base film may be opposite to a direction in which the second terminal is exposed on the base film.

The flexible flat cable may further include a folding portion provided between the first folding area terminal and the second folding area terminal so as to allow the base film to be folded along a folding line that is not parallel to the first direction.

When the flexible flat cable is folded, a position, in which the first folding area terminal is formed, may overlap with a position, in which the second folding area terminal is formed, The flexible flat cable may be configured to be connected to a connector including two connecting portions, and when the flexible flat cable is folded, the first folding area terminal and the second folding area terminal may be connected to the connecting portions of the connector, respectively.

The first conducting wire and the second conducting wire may process different signals or powers independently of each other when the flexible flat cable is connected the connector.

When the flexible flat cable is folded, the first terminal and the second terminal may be connected to a plurality of connectors, respectively.

The flexible flat cable may further include a reinforcing film disposed on one surface opposite to one surface of the base film so as to support the folding portion.

The folding portion may include a plurality of perforations formed along the folding line.

The folding portion may include a groove provided to extend along the folding line.

A length of the first conducting wire in the first direction may be different from a length of the second conducting wire in the first direction.

The first conducting wire or the second conducting wire may be provided in plural, and the plurality of the first conducting wires or the plurality of the second conducting wires may be arranged in a width direction of the base film.

In accordance with another aspect of the disclosure, a flexible flat cable configured to be connectable to a connector, the flexible flat cable includes a base film provided to extend in a first direction, a first conducting wire portion including a first conducting wire provided to extend in the first direction on the base film, and a second conducting wire portion disposed next to the first conducting wire portion in the first direction, and including a second conducting wire provided to extend in the first direction on the base film and arranged spaced apart from the first conducting wire. The base film is foldable to overlap the first conducting wire portion with the second conducting wire portion.

The flexible flat cable may further include a folding portion configured to allow the base film to be folded along a folding line that is not parallel to the first direction between the first conducting wire portion and the second conducting wire portion.

The flexible flat cable may further include a cover film arranged on the base film to cover the first conducting wire portion and the second conducting wire portion, the cover film configured to expose opposite ends of the first conducting wire and opposite ends of the second conducting wire to the outside.

The connector may include two connecting portions, and when the exposed one end of the first conducting wire is defined as a first folding area terminal and the exposed one end of the second conducting wire facing the first folding area terminal is defined as a second folding area terminal, the first folding area terminal and the second folding area terminal may be connected to the connecting portion of the connector, respectively, when the flexible flat cable is folded.

The first conducting wire or the second conducting wire may be provided in plural, and the plurality of the first conducting wires or the plurality of the second conducting wires may be arranged in a width direction of the base film.

In accordance with another aspect of the disclosure, a flexible flat cable configured to be connectable to a connector, the flexible flat cable includes a base film provided to extend in a first direction and configured to be foldable, a conducting wire provided to extend in the first direction on the base film and including a first terminal provided on one end thereof and a second terminal provided on the other end thereof, and a folding portion formed on opposite ends of the conducting wire to allow the base film and the conducting wire to be folded along a folding line that is not parallel to the first direction between the opposite ends of the conducting wire. As the base film is folded, the conducting wire is cut and a first folding area terminal and a second folding area terminal are formed.

The flexible flat cable may further include a cover film arranged on the base film to cover the conducting wire, and configured to expose the first folding area terminal and the second folding area terminal to the outside.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
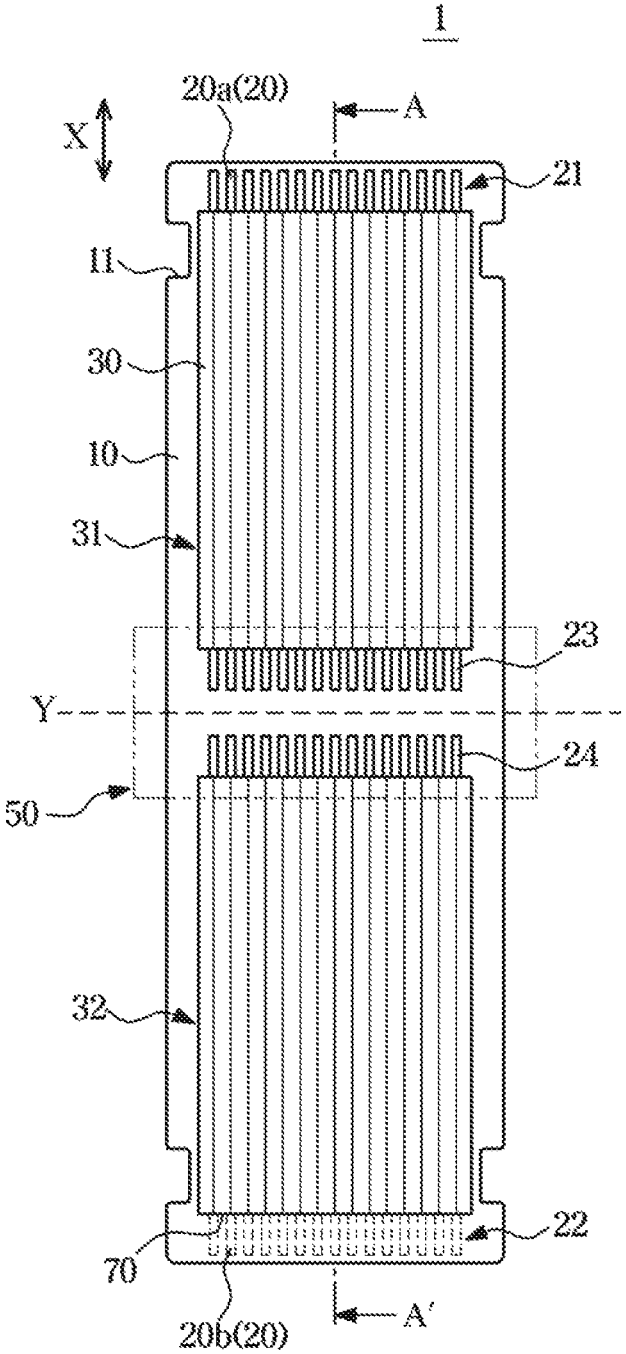
FIG. 1 is a plan view of a flexible flat cable according to an embodiment of the disclosure.

Embodiments described in the disclosure and configurations illustrated in the drawings are merely examples of the embodiments of the disclosure, and may be modified in various different ways at the time of filing of the present application to replace the embodiments and drawings of the disclosure.

In addition, the same reference numerals or signs illustrated in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

In the following detailed description, the terms of "up and down direction", "lower sider", and "front and rear direction" may be defined by the drawings, but the shape and the location of the component is not limited by the term.

Figure 2:
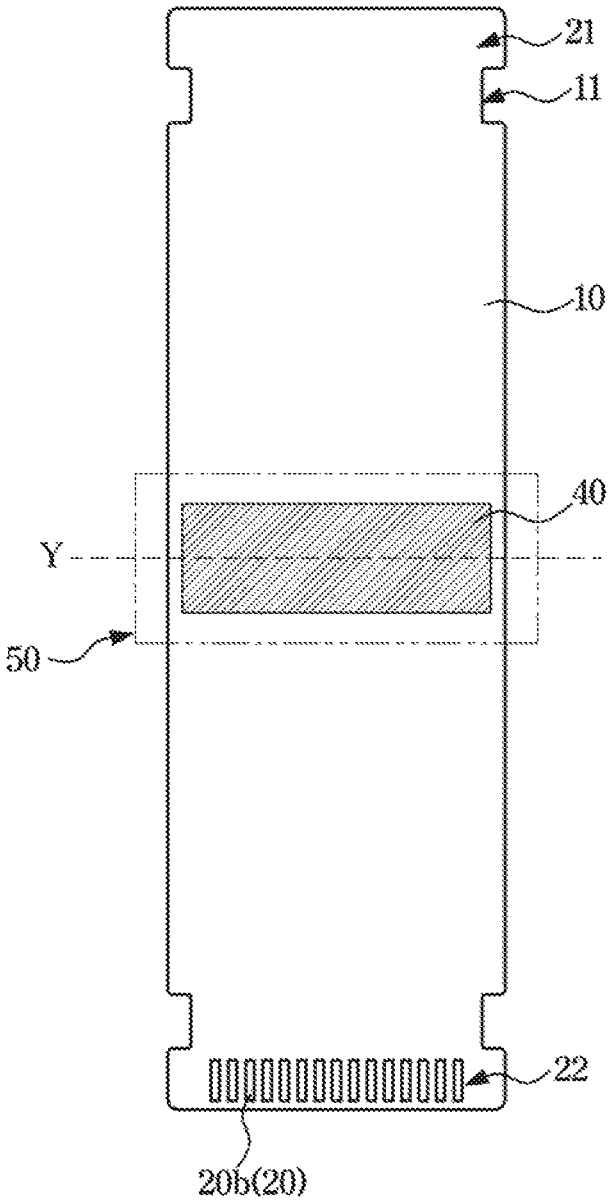
FIG. 2 is a rear view of FIG. 1.
Figure 3:
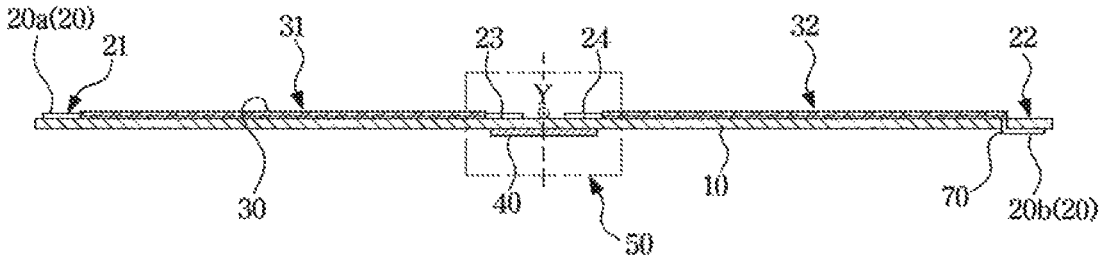
FIG. 3 is a cross-sectional view taken along line A-A' of FIG. 1.

The disclosure will be described more fully hereinafter with reference to the accompanying drawings FIG. 1 is a plan view of a flexible flat cable 1 according to an embodiment of the disclosure. FIG. 2 is a rear view of FIG. 1. FIG. 3 is a cross-sectional view taken along line A-A' of FIG. 1.

Referring to FIGS. 1 to 3, the flexible flat cable 1 may include a base film 10, a conducting wire 20, a cover film 30, and a reinforcing film 40. The conducting wire 20 may include a first terminal 21, a second terminal 22, a first conducting wire 20*a*, a second conducting wire 20*b*, a first folding area terminal 23, and a second folding area terminal 24.

As illustrated in FIGS. 1 to 3, the base film 10 may be formed to extend so as to have a length and width that is predetermined in a manufacturing process. The base film 10 may be formed of heat-resistant polyester, polyester, or a combination thereof. Particularly, the base film 10 may be formed of a heat-adhesive synthetic resin having mechanical strength, such as tensile strength, and having insulation, heat resistance, flexibility, and resilience. That is, the base film 10 may be selected from synthetic resins including nylon, acetate, and polyester-based resins. Alternatively, the base film 10 may be formed of various materials capable of securing the bendability of the flexible flat cable.

As illustrated in FIG. 1, the conducting wire 20 may be disposed on one surface of the base film 10. As described later, the conducting wire 20 may include the first conducting wire 20*a* and the second conducting wire 20*b*. When a direction in which the base film extends is defined as a first direction, the conducting wire 20 may be arranged in a direction parallel to the direction in which the base film extends. A plurality of conducting wires 20 may be arranged side by side in a width direction of the base film. That is, each of the conducting wires 20 may be disposed adjacent to each other in the width direction, but may be arranged in parallel at regular intervals so as not to be in contact with each other. The conducting wire 20 may be formed of a conductive material because the conducting wire 20 needs to transmit electrical signals or current. The conducting wire 20 may be formed of a material having conductivity such as silver, copper, nickel, cobalt, or a combination thereof. The flexible flat cable 1 may be formed by arranging the conducting wire 20, which is produced through a separate manufacturing process, on one surface of the base film 10 and covering the base film 10 with the cover film 30 and pressing the cover film 30.

Alternatively, the conducting wire 20 may be formed by printing a conductive paste into a stripe shape on a surface of the base film 10. The conductive paste may include a composition in which the content of silver filler is 50 to 70% by weight and binder content is 30 to 50% by weight. In addition to the silver filler, the conductive paste may include copper filler, filler that is formed by coating silver on copper, or a variety of conductive materials such as copper, nickel, cobalt, or a combination of various contents thereof. The printing method may include a variety of printing methods such as gravure printing, inkjet printing, offset printing, silk screen printing, and rotary screen printing.

In order to prevent the conducting wire 20 from being exposed to the outside, it is possible to perform a lamination process that is performed by arranging the cover film 30 on an upper end of the conducting wire 20 and bonding the cover film 30 to the base film 10.

As illustrated in FIGS. 1 and 2, the cover film 30 along with the base film 10 may extend so as to have a length and a width predetermined in the manufacturing process. The cover film 30 may cover the conducting wire 20 disposed on the base film 10 and may be formed to be narrower than the width of the base film 10. The cover film 30 may be formed of heat-resistant polyester, polyester, or a combination thereof. Particularly, the cover film 30 may be formed of a heat-adhesive synthetic resin having mechanical strength such as tensile strength, and having insulation, heat resistance, flexibility, and resilience. That is, the cover film 30 may be selected from synthetic resins including nylon, acetate, and polyester-based resins. In addition, the cover film 30 may be formed of various materials that secure the bendability of the flexible flat cable.

Hereinafter the direction in which the flexible flat cable 1 extends is defined as a first direction X and an arrangement of the conducting wire 20 and the cover film 30 of the flexible flat cable 1 according to an embodiment of the disclosure will be described.

As illustrated in FIGS. 1 to 3, the conducting wire 20 placed on the base film 10 may include the first conducting wire 20*a* and the second conducting wire 20*b*.

Particularly, the first conducting wire 20*a* may extend in the first direction X on the base film. For example, as can be seen in FIG. 1, the first conducting wire 20*a* may longitudinally extends in the first direction X. The first conducting wire 20*a* may include the first terminal 21 provided at one end of the first conducting wire 20*a* and the first folding area terminal 23 provided at the other end of the first conducting wire 20*a*. The second conducting wire 20*b* may be disposed next to the first conducting wire 20*a* in the first direction X. For example, as can be seen in FIG. 1, the first conducting wire 20*a* may longitudinally extends in the first direction X, and, as seen in FIG. 1 may be in line with the first conducting wire 20*a* in the first direction X. The second conducting wire 20*b* may include the second folding area terminal 24 provided at one end of the second conducting wire 20*b* and the second terminal 22 provided at the other end of the second conducting wire 20*b*. The second folding area terminal 24 may be spaced apart from the first folding area terminal 23 of the first conducting wire 20*a* in the first direction X. In addition, a plurality of conducting wires 20 (the first conducting wire 20*a* and the second conducting wire 20*b*) may be arranged side by side in the width direction of the base film. That is, each of the conducting wires 20 may be disposed adjacent to each other in the width direction, but may be arranged in parallel at regular intervals so as not to be in contact with each other. In this case, a region, in which a plurality of first conducting wires 20*a* is formed, may be defined as a first conducting wire portion 31 and a region, in which a plurality of second conducting wires 20*b* is formed, may be defined as a second conducting wire portion 32.

The first conducting wire 20*a* and the second conducting wire 20*b* may be arranged in such a way that the first terminal 21, the first folding area terminal 23, the second folding area terminal 24 and the second terminal 22 are arranged in order in the first direction X on the base film 10. The base film 10 and the cover film 30 may be formed of a heat-adhesive resin and thus the base film 10 and the cover film 30 may be bonded to each other by the lamination process while the plurality of conducting wires (the first conducting wire 20*a* and the second conducting wire 20*b*), which is arranged in parallel at regular intervals, is arranged therebetween. In this case, the lamination process may be performed on the cover film 30 in such a way that the first terminal 21, the first folding area terminal 23, the second folding area terminal 24 and the second terminal 22 are exposed. The first terminal 21, the first folding area terminal 23, the second folding area terminal 24 and the second terminal 22, which are exposed, may be formed to have a certain length, which is determined according to a connector connected thereto, so as to prevent an error in the connection.

The first terminal 21, the first folding area terminal 23, the second folding area terminal 24 and the second terminal 22, which are exposed, may be plated with nickel and gold (Ni/Au) so as to be oxidized with improved conductivity, thereby preventing increase in the resistance.

Hereinafter a connection strengthening portion 11 will be described with reference to FIGS. 1, 2 and 4.

As illustrated in FIG. 1, as for the base film 10, the vicinity of the first terminal 21 and the second terminal 22 may be deformed to strengthen the connection with a connector 60 and to stably transmit and receive currents or signals. That is, the connection strengthening portion 11 may be formed. Particularly, the base film 10 may be deformed in such a way that the base film 10 is dented in the width direction in the vicinity of the first terminal 21 where the conducting wire starts to be exposed from the cover film 30. The connector 60 may be provided with a fastening portion (not shown) having a shape corresponding to the connection strengthening portion 11 of the flexible flat cable. Accordingly, a stable connection between the flexible flat cable 1 and the connector 60 may be secured by connecting the connection strengthening portion 11 to the fastening portion (not shown). According to an embodiment of the disclosure, the connection strengthening portion 11 may be formed in a dent form, but is not limited thereto. Alternatively, the connection strengthening portion 11 may be formed in a variety of forms capable of strengthening the connection between the flexible flat cable 1 and the connector 60. Alternatively, other than the deformation of the base file 10, the cover film 30 and the conducting wire 20 may be deformed so as to form the connection strengthening portion 11.

Hereinafter a specific arrangement of the first folding area terminal 23 and the second folding area terminal 24 and a processing of electrical signals or currents of the first conducting wire 20*a* and the second conducting wire 20*b* will be described with reference to FIGS. 1 to 4.

As illustrated in FIGS. 1 and 2, the direction, in which the flexible flat cable 1 extends, may be defined as the first direction X. Further, a line that is not parallel to the first direction X may be defined as a folding line Y. The folding line Y may be positioned between the first folding area terminal 23 and the second folding area terminal 24. That is, the flexible flat cable 1 may include the first folding area terminal 23 and the second folding area terminal 24 which expose the conducting wire (the first conducting wire 20*a*, and the second conducting wire 20*b*) between the first terminal 21 and the second terminal 22, and which are formed side by side with respect to the folding line Y.

As illustrated in FIG. 1, before the flexible flat cable 1 is folded, the first folding area terminal 23 and the second folding area terminal 24 may be arranged to face each other. As described above, the second conducting wire 20*b* may be disposed next to the first conducting wire 20*a* in the first direction X, and the second conducting wire 20*b* may be arranged to allow the second folding area terminal 24 of the second conducting wire 20*b* to be spaced apart from the first folding area terminal 23 of the first conducting wire 20*a* in the first direction X.

In other words, the first folding area terminal 23 and the first terminal 21 may be located at opposite ends of the first conducting wire 20*a*, respectively. The second folding area terminal 24 and the second terminal 22 may be located at opposite ends of the second conducting wire 20*b*, respectively. The first conducting wire 20*a* and the second conducting wire 20*b* may not be electrically connected to each other, but may be disposed on the same base film 10. That is, the first conducting wire 20*a* and the second conducting wire 20*b* may be configured to process different signals or currents independently of each other.

Figure 4:
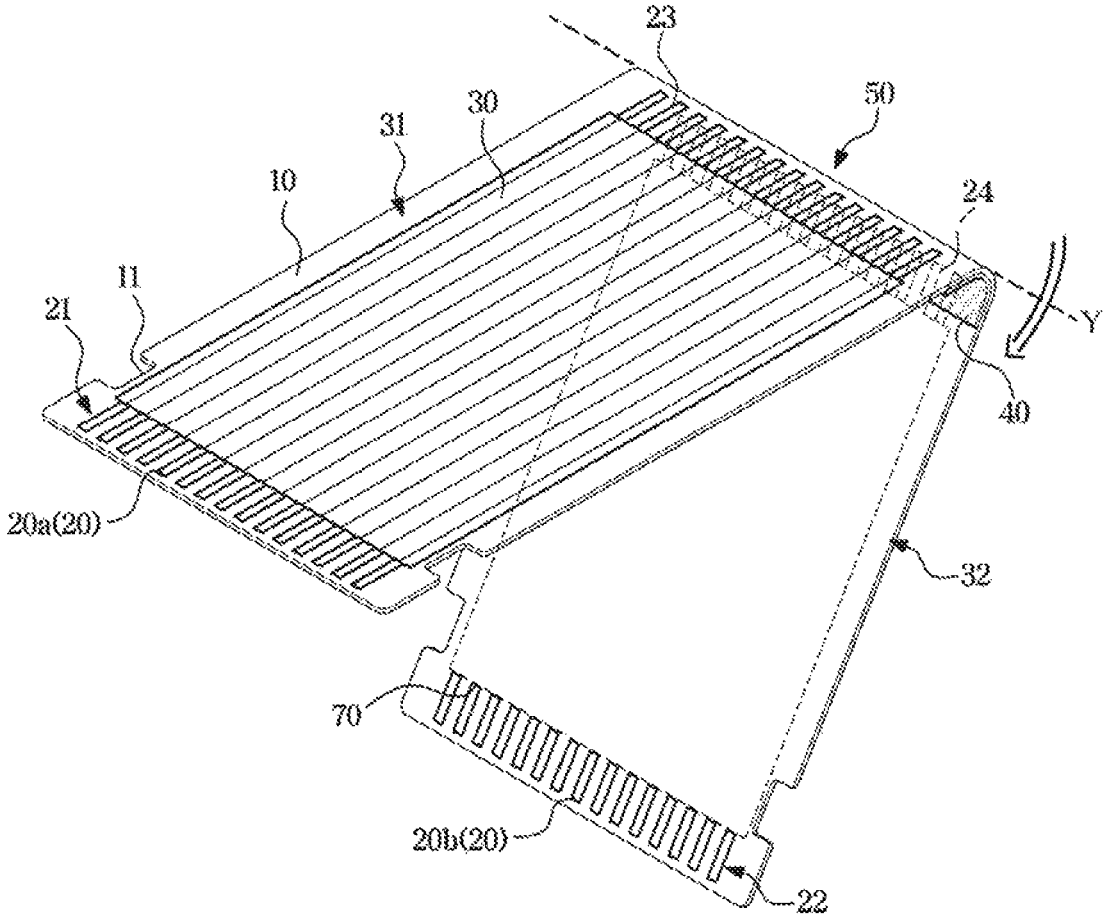
FIG. 4 is a view illustrating a process in which a folding portion of the flexible flat cable is folded according to an embodiment of the disclosure.
Figure 5:
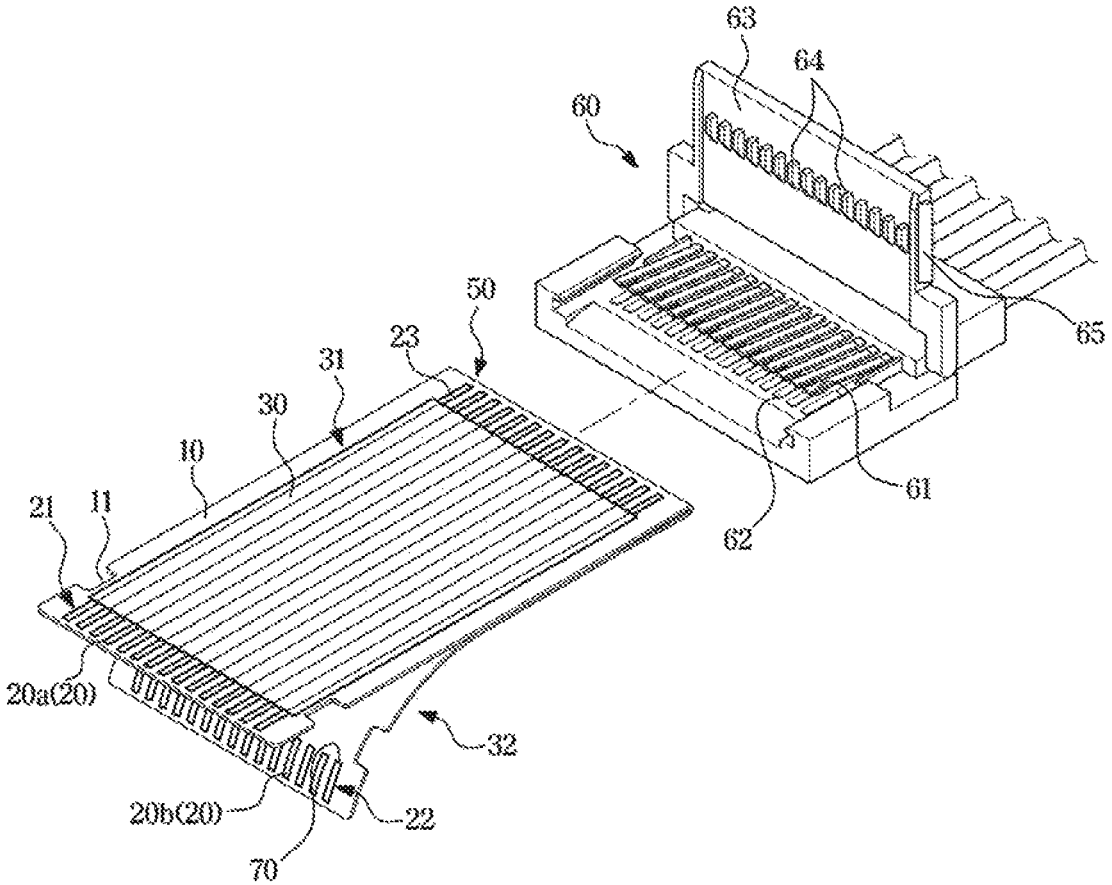
FIG. 5 is a view illustrating a process in which the flexible flat cable, in a state in which the folding portion is folded, is connected to a connector according to an embodiment of the disclosure.
Figure 6:
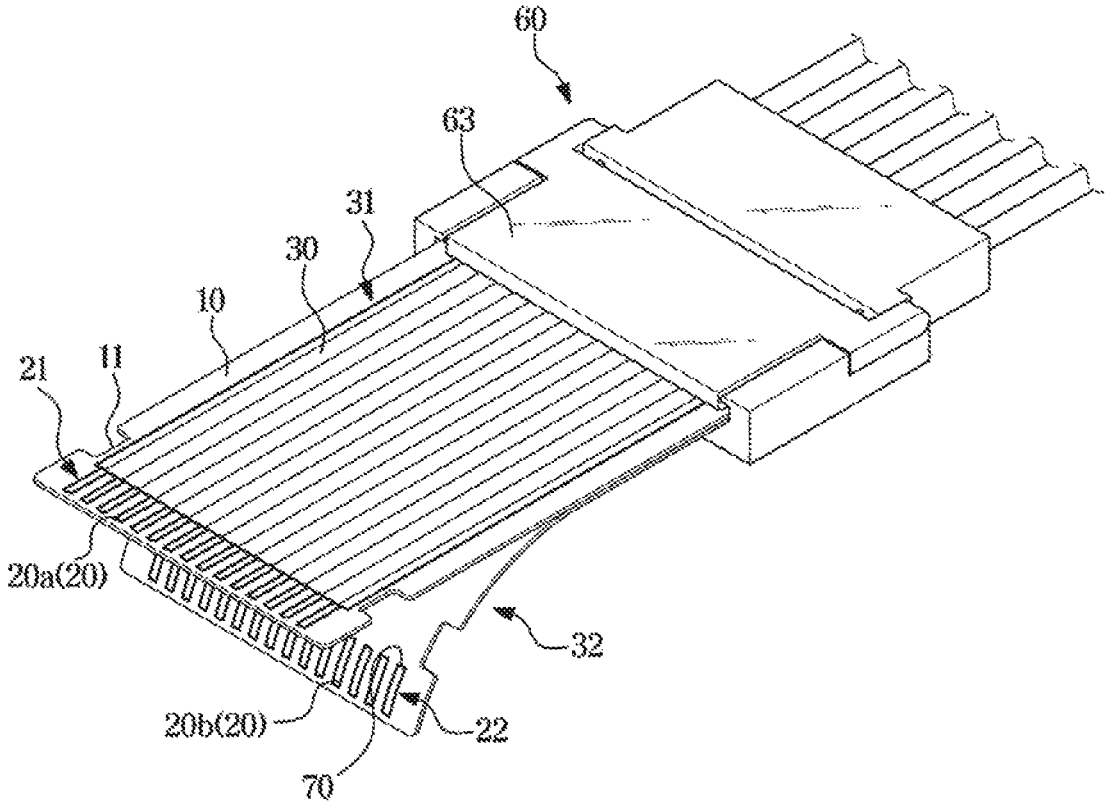
FIG. 6 is a view illustrating a state in which a connection between the flexible flat cable and the connector is completed according to an embodiment of the disclosure.

FIG. 4 is a view illustrating a process in which a folding portion 50 of the flexible flat cable 1 is folded according to an embodiment of the disclosure. FIG. 5 is a view illustrating a process in which the flexible flat cable, in a state in which the folding portion 50 is folded, is connected to the connector 60 according to an embodiment of the disclosure. FIG. 6 is a view illustrating a state in which a connection between the flexible flat cable 1 and the connector 60 is completed according to an embodiment of the disclosure.

The flexible flat cable 1 may include the folding portion 50 formed along the folding line Y. The folding portion 50 may be formed between the first folding area terminal 23 and the second folding area terminal 24 on the base film 10. The flexible flat cable 1 may be configured in such a way that when the base film 10 is folded with respect to the folding portion 50, a position, in which the first folding area terminal 23 is formed, overlaps with a position, in which the second folding area terminal 24 is formed, in the up and down direction. That is, when the base film 10 is folded with respect to the folding portion 50, the first folding area terminal 23 may be positioned on an upper base film 10 adjacent to the folding portion 50, and the second folding area terminal 24 may be positioned on a lower base film 10 adjacent to the folding portion 50.

A region, in which the plurality of first conducting wires 20*a* is formed, may be defined as the first conducting wire portion 31 and a region, in which the plurality of second conducting wires 20*b* is formed, may be defined as the second conducting wire portion 32. The flexible flat cable 1 may be configured in such a way that when the base film 10 is folded with respect to the folding portion 50, the first conducting wire portion 31 overlaps with the second conducting wire portion 32 in the up and down direction.

As illustrated in FIGS. 5 and 6, the flexible flat cable 1 may be configured to be connected to the connector 60 including two connecting portions 61 and 62. The connector 60 may include a first connecting portion 61, a second connecting portion 62, a fastening member 65, a cover 63 and a pressing portion 64.

The first connecting portion 61 and the second connecting portion 62 may be formed to correspond to the first folding area terminal 23 and the second folding area terminal 24, respectively. When the plurality of conducting wires 20 (the first conducting wire 20*a* and the second conducting wire 20*b*) is arranged side by side in the width direction of the base film, the first connecting portion 61 may be composed of the same number of connection pins as the number of the exposed first folding area terminal 23. In the same manner, the second connecting portion 62 may be composed of the same number of connection pins as the number of the exposed second folding area terminal 24.

The flexible flat cable 1 is configured in such a way that the first folding area terminal 23 is in contact with the first connecting portion 61 of the connector 60 after the base film 10 is folded with respect to the folding portion 50. In the similar manner, the second folding area terminal 24 is in contact with the second connecting portion 62 of the connector 60. When the plurality of conducting wires 20 (the first conducting wire 20*a* and the second conducting wire 20*b*) is arranged side by side in the width direction of the base film, the exposed plurality of the first folding area terminals 23 may be in contact to correspond to the connection pins of the first connecting portion 61. In the same manner, the exposed plurality of the second folding area terminal 24 may be in contact to correspond to the connection pins of the second connecting portion 62.

The pressing portion 64 formed on the inner side of the cover may press an upper end of first connecting portion 61 when the cover is closed after the first and second folding area terminals 23 and 24 are in contact with the first and second connecting portions 61 and 62, respectively. Particularly, the pressing portion 64 may include a pressing protrusion 64 protruding from the inside of the cover 63 to have a shape corresponding to the first connecting portion 61. Therefore, when the pressing protrusion 64 presses the connection pin of first connecting portion 61 corresponding to the pressing protrusion 64, the pressing protrusion 64 may press the first folding area terminal 23 and the second folding area terminal 24, which overlap in the up and down direction, in order. Finally, when the cover 63 is fixed through the fastening member 65, the flexible flat cable 1 may be fastened so as not to be separated from the connector 60.

Hereinafter an arrangement of the first terminal 21 and the second terminal 22 on the base film 10 will be described with reference to FIGS. 1, 2, and 4.

As shown in FIGS. 1 to 3, either the first terminal 21 or the second terminal 22 may be formed on one surface of the base film 10 and the other thereof may be formed on a surface opposite to the one surface. This is because when the flexible flat cable 1 is folded in a state in which both the first terminal 21 and the second terminal 22 are formed on the same surface of the base film 10, a direction in which the first terminal 21 is formed may be different from a direction in which the second terminal 21 is formed. In this case, an installation direction of the connector (not shown) connected to the first terminal 21 of the first conducting wire 20*a* may be different from an installation direction of the connector (not shown) connected to the second conducting wire 20*b*. As a result, it may cause a difficulty in which any one of the first conducting wire 20*a* and the second conducting wire 20*b* is twisted to match the installation direction.

Therefore, a perforation 70 may be formed in a part of the base film 10 in which the exposure of the first terminal 21 or the second terminal 22 starts from the cover film 30. Further, when the plurality of conducting wires 20 (the first conducting wire 20*a*, and the second conducting wire 20*b*) is arranged side by side in the width direction of the base film, a plurality of perforations 70 corresponding to the first terminal 21 or the second terminal 22 may be formed on the base film 10.

The flexible flat cable 1 may be formed by arranging the conducting wire 20 (the first conducting wire 20*a*, and the second conducting wire 20*b*), which is produced through a separate manufacturing process, on one surface of the base film 10 and covering the base film 10 with the cover film 30 and pressing the cover film 30. In this case, any one of the first conducting wire 20*a* and the second conducting wire 20*b* may be arranged to pass through the perforation 70 formed in the base film 10.

Alternatively, the flexible flat cable 1 may be manufactured in such a way that the conducting wire 20 is formed by printing a conductive paste in a stripe form on one surface of the base film 10 and then the conducting wire 20 is covered by the film cover 30 and then pressed. In this case, a method of filling the conductive paste in the perforation 70 formed in the base film 10 may be applied. That is, the conductive paste may be filled in the perforation 70 to connect the first conducting wire 20*a* formed on one surface of the base film 10 to the first terminal 21 formed on the other surface of the base film 10. Alternatively, the conductive paste may be filled in the perforation 70 to connect the second conducting wire 20*b* formed on one surface of the base film 10 to the second terminal 22 formed on the other surface of the base film 10.

Figure 7:
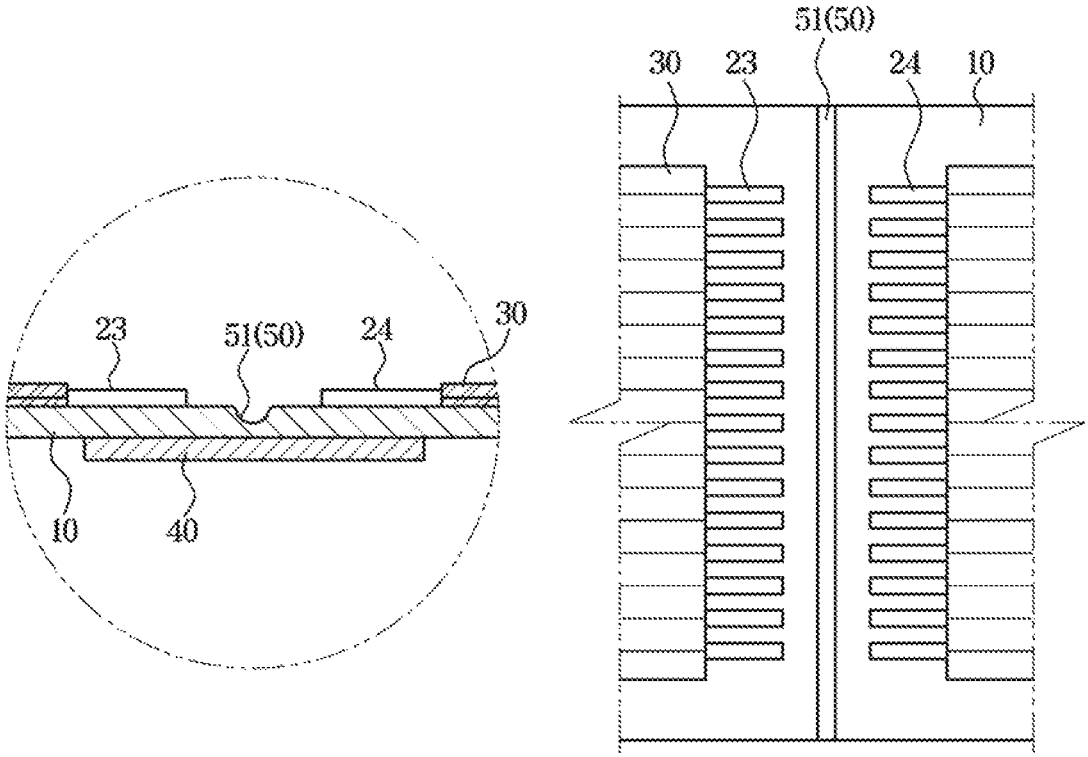
FIG. 7 is a view illustrating an example in which the folding portion of the flexible flat cable includes a groove according to an embodiment of the disclosure.
Figure 8:
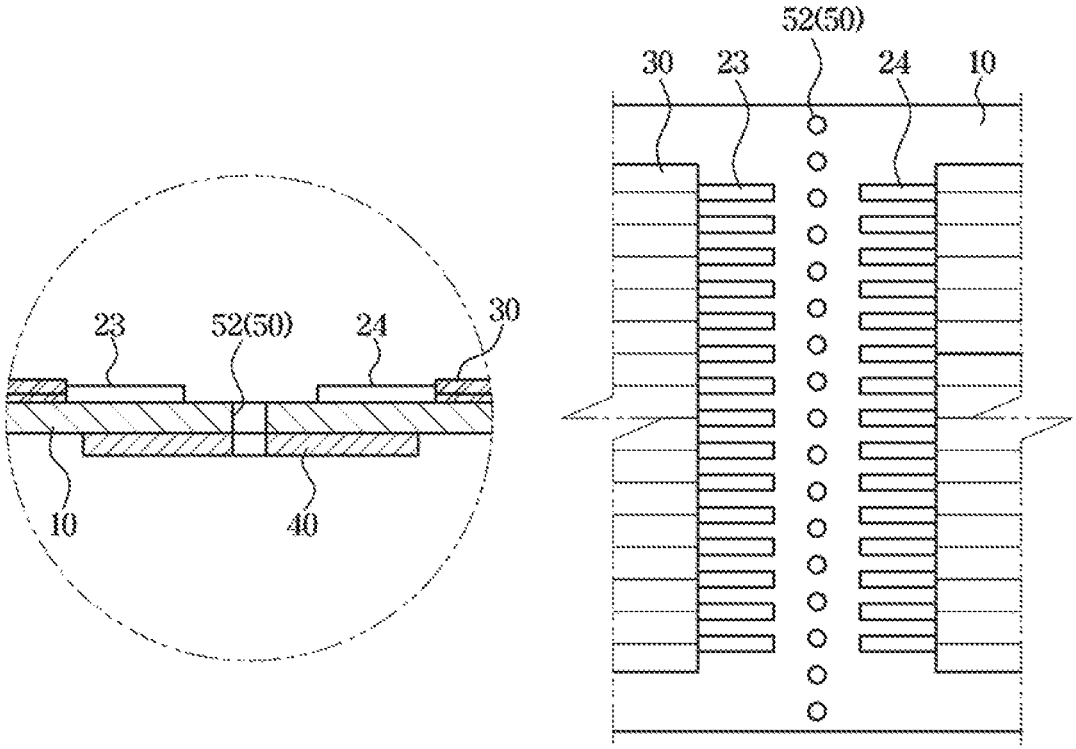
FIG. 8 is a view illustrating an example in which the folding portion of the flexible flat cable includes a plurality of perforations according to an embodiment of the disclosure.

FIG. 7 is a view illustrating that the folded portion 50 of the flexible flat cable 1 of FIG. 1 includes a groove that is pressed and extends along the folding line. FIG. 8 is a view illustrating that the folded portion 50 of the flexible flat cable 1 of FIG. 1 includes a line including a plurality of perforations.

As shown in FIGS. 7 and 8, the flexible flat cable 1 may further include a folding portion 50 formed along the folding line Y intersecting the first direction X between the first folding area terminal 23 and the second folding area terminal 24 on the base film 10. The folding portion 50 may include a groove shape 51 formed along the folding line Y on the base film 10 so as to allow the flexible flat cable 1 to be easily folded. Alternatively, a plurality of perforations 52 may be formed along the folding line Y on the base film 10 so as to allow the flexible flat cable 1 to be easily folded. By forming the groove shape 51 or the plurality of perforations 52 as described above, it is possible to more easily fold the base film 10 to be fastened to the connector 60.

As illustrated in FIGS. 1 to 3, the flexible flat cable 1 may further include a reinforcing film 40 arranged on a surface opposite to one surface of the base film. As illustrated in FIGS. 1 to 3, the reinforcing film 40 may be arranged on a surface opposite to one surface, on which the conducting wire 20 is arranged, of the base film 10 so as to support the first folding area terminal 23 and the second folding area terminal 24. By arranging the reinforcing film 40, electromagnetic shielding may be obtained between the first folding area terminal 23 and the second folding area terminal 24 so as to process the current or signal more efficiently. In addition, it is possible to prevent the folding portion 50 of the base film 10 from being damaged that may occur when the base film 10 is folded to be fastened to the connector 60.

Figure 9:
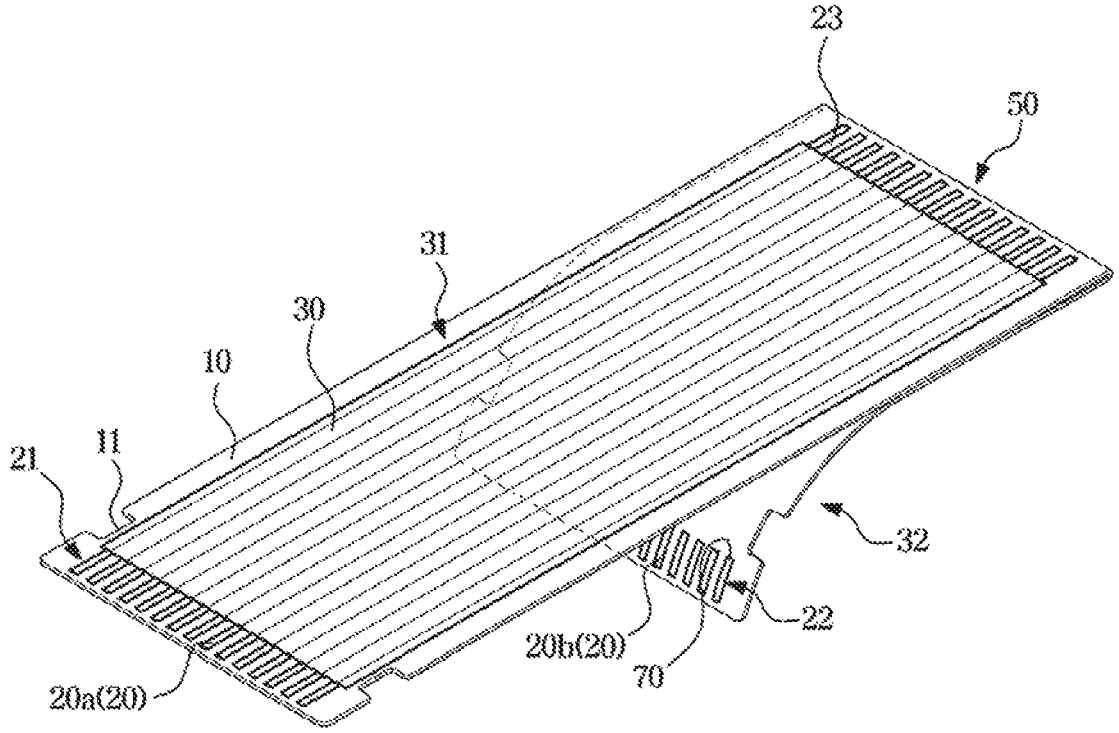
FIG. 9 is a view of a flexible flat cable according to another embodiment of the disclosure.

FIG. 9 is a view of a flexible flat cable according to another embodiment of the disclosure.

As mentioned above, the first conducting wire 20*a* and the second conducting wire 20*b* may not be electrically connected to each other, but may be arranged on the same base film 10. That is, the first conducting wire 20*a* and the second conducting wire 20*b* may be configured to process different signals or currents independently of each other. As illustrated in FIG. 8, a length of the first conducting wire 20*a* may be different from a length of the second conducting wire 20*b*. That is, the first conducting wire 20*a* and the second conducting wire 20*b* may have different lengths according to the use of the flexible flat cable 1 or the design in the manufacturing process. The flexible flat cable 1 may allow electronic components to be efficiently and compactly arranged in electronic devices because the first conducting wire 20*a* and the second conducting wire 20*b* may have different lengths.

Figure 10:
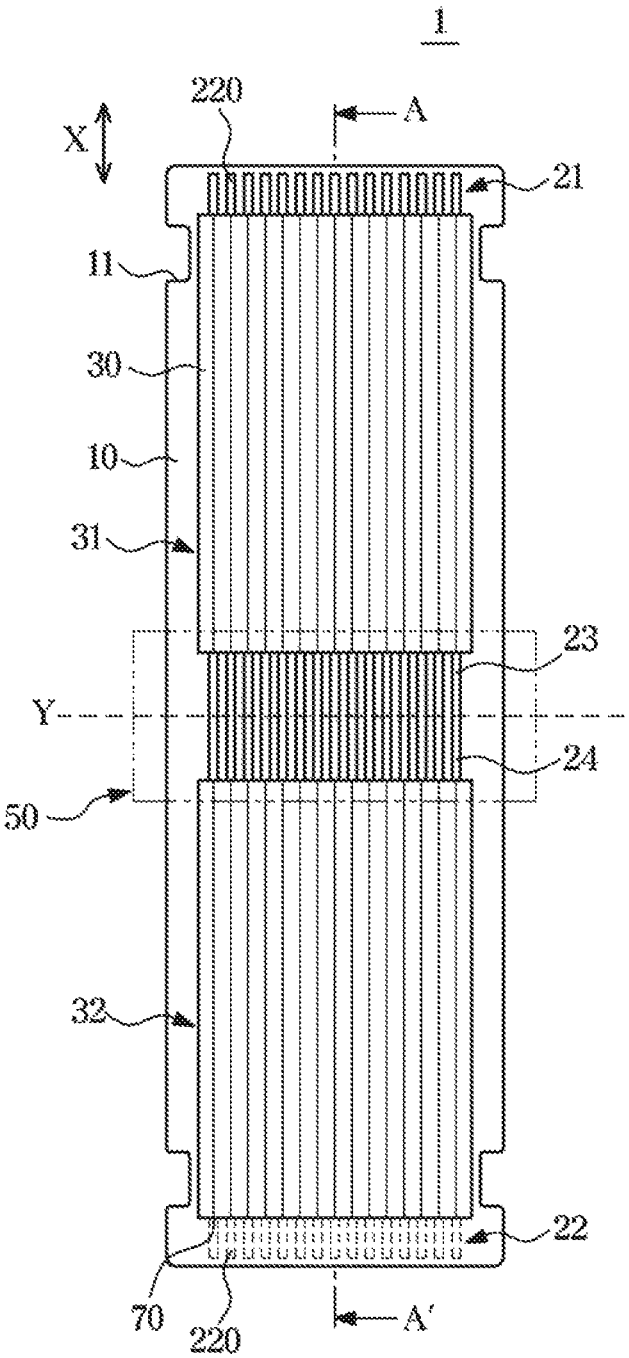
FIG. 10 is a plan view of a flexible flat cable according to a still another embodiment of the disclosure.
Figure 11:
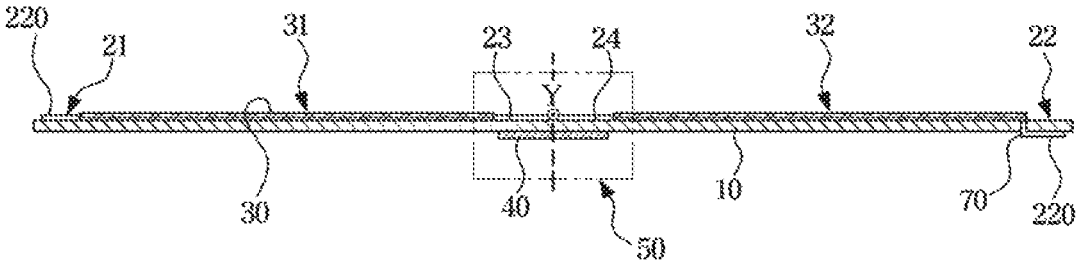
FIG. 11 is a cross-sectional view taken along line A-A' of FIG. 10.
Figure 12:
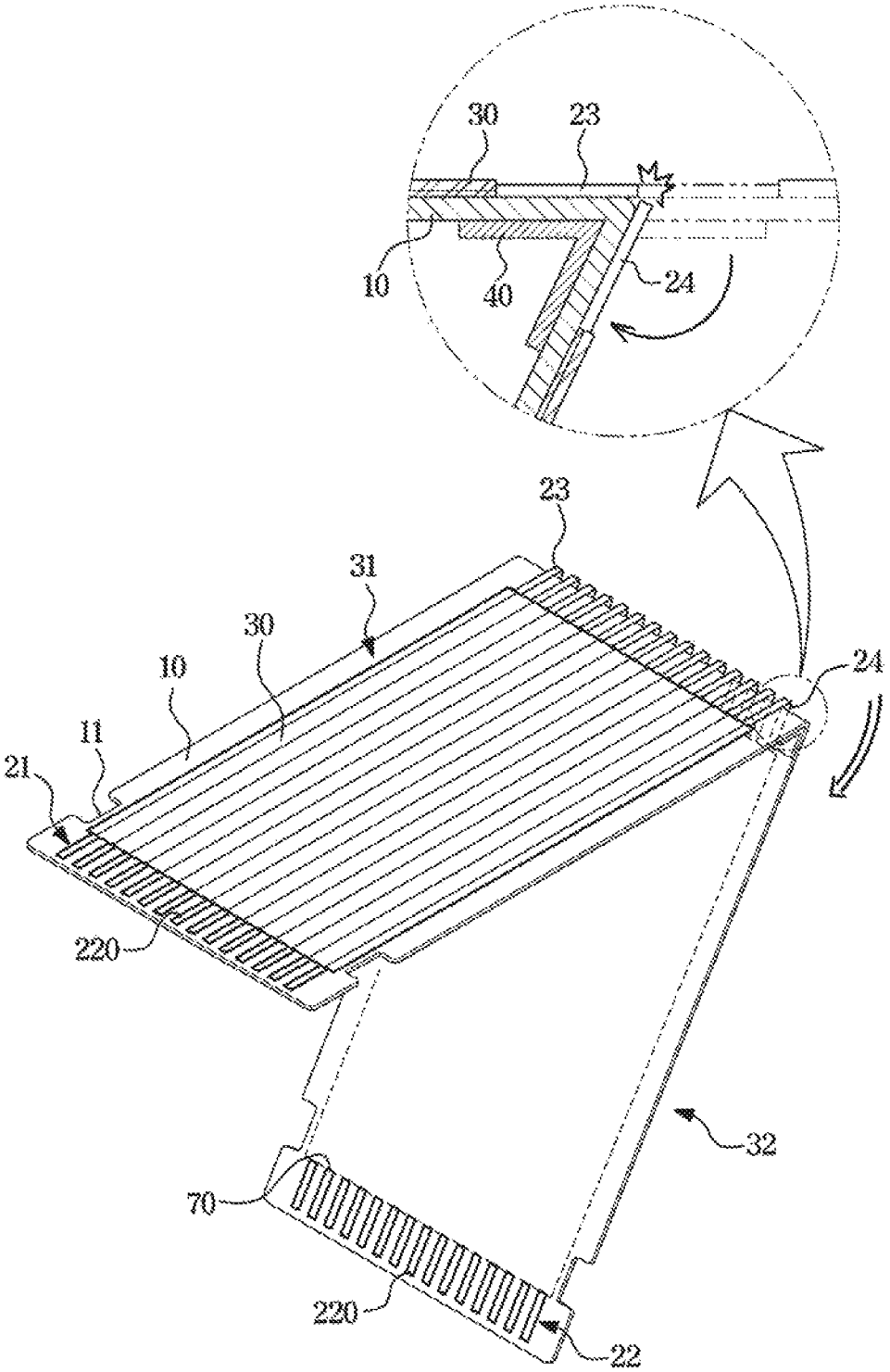
FIG. 12 is a view illustrating a process in which a folding portion of the flexible flat cable of FIG. 10 is folded and a process of forming a first folding area terminal and a second folding area terminal.

FIG. 10 is a plan view of a flexible flat cable 2 according to a still another embodiment of the disclosure. FIG. 11 is a cross-sectional view taken along line A-A' of FIG. 10. FIG. 12 is a view illustrating a process in which when the flexible flat cable 2 of FIG. 10 is folded through a folding portion 50, a conducting wire arranged in the folding portion 50 is cut along a folding line Y and a first folding area terminal 23 and a second folding area terminal 24 are formed.

As illustrated in FIGS. 10 and 11, the flexible flat cable 2 may basically include a base film 10, a conducting wire 220, a cover film 30, and a reinforcing film 40, which is the same manner as the flexible flat cable 1 of FIG. 1.

The conducting wire 220 may be arranged on one surface of the base film 10. In the case of the flexible flat cable 1 according to an embodiment of the disclosure, the first conducting wire 20*a* and the second conducting wire 20*b*, which are separated from each other, are disposed on the base film 10. On the other hand, the flexible flat cable 2 of FIG. 10 may be arranged in such a way that a single conducting wire 220, which is instead of the conducting wires separated from each other, extends in a first direction X on the base film 10. A plurality of conducting wires 220 may be arranged side by side in a width direction of the base film. That is, each of the conducting wires 220 may be disposed adjacent to each other in the width direction, but may be arranged in parallel at regular intervals so as not to be in contact with each other.

The cover film 30 along with the base film 10 may extend so as to have a length and a width predetermined in the manufacturing process. The cover film 30 may cover the conducting wire 20 disposed on the base film 10 and may be formed to be narrower than the width of the base film 10.

The base film 10 and the cover film 30 may be formed of a heat-adhesive resin and thus the base film 10 and the cover film 30 may be bonded to each other by the lamination process while the plurality of conducting wires 220, which is arranged in parallel at regular intervals, is arranged therebetween. In this case, the lamination process may be performed on the cover film 30 in such a way that the first terminal 21, the first folding area terminal 23, the second folding area terminal 24 and the second terminal 22 are exposed.

A specific arrangement of the first folding area terminal 23 and the second folding area terminal 24 and a processing of an electrical signal or a current of the first conducting wire 20*a* and the second conducting wire 20*b* are basically the same as the above mentioned flexible flat cable 1 of FIG. 1. The flexible flat cable 2 may further include a folding portion 50 formed along a folding line Y that intersects the first direction X or that is not parallel to the first direction X between the first folding area terminal 23 and the second folding area terminal 24 on the base film 10. However, in order to process different signals or currents independently of each other, the first conducting wire 20*a* and the second conducting wire 20*b* may be different in the structure of forming the first folding area terminal 23 and the second folding area terminal 24.

FIG. 12 is a view illustrating a process in which a folding portion of the flexible flat cable of FIG. 10 is folded and a process of forming a first folding area terminal and a second folding area terminal.

Particularly, in a state before folding, the flexible flat cable 2 may be in a state in which a single conducting wire 220 is arranged to extend in the first direction X on the base film, which is different from the flexible flat cable 1 of FIG. 1 in which separate conducting wires are arranged to extend in the first direction X on the base film. In other words, the first folding area terminal 23 and the second folding area terminal 24 may be in a state of being physically connected. A fact that the conducting wires 220 are arranged side by side in the width direction of the base film is the same as the flexible flat cable 1 according to an embodiment of the disclosure.

In a process of folding the folding portion 50, the conducting wire 220 arranged on the folding portion may be cut and thus the first folding area terminal 23 and the second folding area terminal 24 in a physically separated state may be formed. The flexible flat cable 1 may be configured in such a way that when the base film 10 is folded with respect to the folding portion 50, a position, in which the first folding area terminal 23 is formed, overlaps with a position, in which the second folding area terminal 24 is formed, in the up and down direction. That is, when the base film 10 is folded with respect to the folding portion 50, the first folding area terminal 23 may be positioned on an upper base film 10 adjacent to the folding portion 50, and the second folding area terminal 24 may be positioned on a lower base film 10 adjacent to the folding portion 50.

Except the above mentioned contents, a process in which the flexible flat cable 2 is connected to the connector 60 or a state in which the connection is completed is the same as the flexible flat cable 1 in FIG. 1. In addition, it is also apparent that the folding portion is formed on the flexible flat cable 2 of FIG. 10 or the first conducting wire 20*a* and the second conducting wire 20*b* are set to have different lengths in a manner as illustrated in FIGS. 7 to 9.

As is apparent from the above description, the flexible flat cable may increase space utilization in electronic devices by including the folding portion folded along a line intersecting an extension line of the base film and by forming an independent conducting wire portion.

Further, by forming an independent conducting wire portion on a single base film, the flexible flat cable may secure processing efficiency, which is to obtain an effect of manufacturing two cables by manufacturing a single cable, while maintaining an existing manufacturing process and the flexible flat cable may have material cost reduction effect.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A flexible flat cable having an extended state and, when in the extended state, being foldable to be in a folded state, the flexible flat cable comprising:

a base film that, when the flexible flat cable is in the extended state, longitudinally extends in a first direction and, when the flexible flat cable is folded to be in the folded state, folds along a folding line;

a first conducting wire including a first terminal and a first folding area terminal, and, when the flexible flat cable is in the extended state, the first conducting wire longitudinally extends in the first direction from the first terminal to the first folding area terminal, with the first folding area terminal being to a first side of the folding line; and a second conducting wire including a second terminal and a second folding area terminal, and, when the flexible flat cable is in the extended state, the second conducting wire longitudinally extends in the first direction from the second folding area terminal to the second terminal, with the first folding area terminal and the second folding area terminal being between the first terminal and the second terminal, and the second folding area terminal being to a second side of the folding line, wherein at least part of the first conducting wire that includes the first folding area terminal and at least part of the second conducting wire that includes the second folding area terminal fold toward each other when the base film folds along the folding line, the flexible flat cable is configured to be connected to a connector that includes first and second connecting portions, when the flexible flat cable is in the folded state with the base film folded along the folding line, the first folding area terminal and the second folding area terminal are connectable to the first and second connecting portions of the connector, respectively, and when the flexible cable is connected to the connector with the first folding area terminal and the second folding area terminal connected to the first and second connecting portions of the connector, respectively, the first conducting wire and the second conducting wire are configured to process different signals or powers independently of each other.

2. The flexible flat cable of claim 1, further comprising:

a cover film covering a portion of the first conducting wire and a portion of the second conducting wire, while exposing the first terminal and the first folding area terminal of the first conducting wire and the second terminal and the second folding area terminal of the second conducting wire to outside.

3. The flexible flat cable of claim 1, wherein, when the flexible flat cable is in the extended state, the first terminal is in line with the second terminal in the first direction.

4. The flexible flat cable of claim 1, wherein the folding line is not parallel to the first direction.

5. The flexible flat cable of claim 4, wherein when the flexible flat cable is in the folded state with the base film folded along the folding line, the first terminal and the second terminal are connectable to a plurality of connectors, respectively.

6. The flexible flat cable of claim 4, further comprising:

a reinforcing film disposed on the second surface of the base film to support the folding of the base film.

7. The flexible flat cable of claim 4, wherein the base film includes a plurality of folding perforations formed along the folding line.

8. The flexible flat cable of claim 4, wherein the base film includes a groove along the folding line.

9. The flexible flat cable of claim 1, wherein a length of the first conducting wire in the first direction is different from a length of the second conducting wire in the first direction.

10. The flexible flat cable of claim 1; further comprising:

a plurality of the first conducting wires arranged in a width direction of the base film, and/or a plurality of the second conducting wires arranged in the width direction of the base film.

11. A flexible flat cable having an extended state and, when in the extended state; being foldable to be in a folded state, and being connectable to a connector, the flexible flat cable comprising:

a base film that, when the flexible flat cable is in the extended state, longitudinally extends in a first direction and, when the flexible flat cable is folded to be in the folded state, folds;

a first conducting wire that, when the flexible flat cable is in the extended state, longitudinally extends above a first surface of the base film in the first direction from a first end of the first conducting wire that is formed above the first surface of the base film to a second end of the first conducting wire that is formed above the first surface of the base film; and a second conducting wire that, when the flexible flat cable is in the extended state, longitudinally extends above the first surface of the base film in the first direction in line with, and spaced apart from, the first conducting wire in the first direction, from a first end of the second conducting wire that is formed above the first surface of the base film to a perforation in the base film, and then extends through the perforation in the base film to a second end of the second conducting wire that is formed above a second surface, opposite to the first surface, of the base film, wherein at least part of the first conducting wire and at east part of the second conducting wire overlap when the base film is folded.

12. The flexible flat cable of claim 11, wherein the base film is foldable along a folding line that is not parallel to the first direction and that is between the first conducting wire and the second conducting wire.

13. The flexible flat cable of claim 11, further comprising:

a cover film covering a portion of the first conducting wire and a portion of the second conducting wire while exposing the first end and the second end of the first conducting wire and the first end and the second end of the second conducting wire to outside.

14. The flexible flat cable of claim 13, wherein the connector comprises first and second connecting portions, and, the second end of the first conducting wire and the first end the second conducting wire that are adjacent to each other along the first direction when the base film longitudinally extends in the first direction, and become connectable to the first and second connecting portions of the connector, respectively, when the base film is folded.

15. The flexible flat cable of claim 11, further comprising:

a plurality of the first conducting wires arranged in a width direction of the base film, and/or a plurality of the second conducting wires arranged in the width direction of the base film.

16. A flexible flat cable having an extended state and, when in the extended state, being foldable to be in a folded state, and being connectable to a connector, the flexible flat cable comprising:

a base film that, when the flexible flat cable is in the extended state, longitudinally extends in a first direction, and, when the flexible flat cable is folded to be in the folded state, folds; and a conducting wire including a first terminal on one end of the conducting wire and formed above a first surface of the base film, and a second terminal on another end of the conducting wire and formed above a second surface, opposite to the first surface, of the base film, wherein, when the flexible flat cable is in the extended state, the conducting wire longitudinally extends above the first surface of the base film in the first direction from the first terminal to a perforation in the base film, and then extends through the perforation in the base film to the second terminal, wherein, as the base film is folded, the conducting wire is cut at a position between the first terminal and the perforation to thereby form a first folding area terminal at one cut end of the conducting wire and a second folding area terminal at another cut end of the conducting wire.

17. The flexible flat cable of claim 16, further comprising:

a cover film covering a portion of the conducting wire while exposing another portion of the conducting wire that is cut when the base film is folded, so that the first folding area terminal and the second folding area terminal are exposed to outside.

18. The flexible flat cable of claim 16, wherein, when the flexible flat cable is in the folded state with the base film folded, the first folding area terminal and the second folding area terminal are connectable to the connector.

* * * * *